United States Patent [19]

Schmidt

[11] Patent Number: 5,000,513

[45] Date of Patent: Mar. 19, 1991

[54] ROTARY TABLE

[76] Inventor: Peter Schmidt, Wittumweg 38, D-7989 Eisenharz, Fed. Rep. of Germany

[21] Appl. No.: 421,171

[22] Filed: Oct. 13, 1989

[30] Foreign Application Priority Data

Oct. 19, 1988 [DE] Fed. Rep. of Germany ..... 3835532

[51] Int. Cl.[5] ..... A47C 3/18

[52] U.S. Cl. ..... 297/441; 297/219; 297/240; 297/349; 248/349; 108/139

[58] Field of Search ..... 297/218, 219, 240, 242, 297/257, 349, 440, 441; 108/103, 104, 139; 248/349, 415, 425

[56] References Cited

U.S. PATENT DOCUMENTS

| | | | |
|---|---|---|---|
| 826,917 | 7/1906 | Bedell | 297/349 |
| 1,732,113 | 10/1929 | van der Meer | 297/139 X |
| 3,009,739 | 11/1961 | Hamilton | 108/139 X |
| 3,063,714 | 11/1962 | Krauss | 248/415 X |
| 3,096,601 | 7/1963 | Henry-Biabaud | 297/218 |
| 3,713,619 | 1/1973 | Marty | 108/139 X |
| 4,034,947 | 7/1977 | Geisel | 297/240 X |

FOREIGN PATENT DOCUMENTS

| | | | |
|---|---|---|---|
| 2170700 | 8/1986 | United Kingdom | 297/240 |

*Primary Examiner*—Peter R. Brown

*Attorney, Agent, or Firm*—Notaro & Michalos

[57] ABSTRACT

A rotary table (10) provided as a seat for a handicapped person consists of a bottom plate (12), a cover plate (14), a cushion mat (16) and a fastening ring (18). The cover plate (14) is mounted for rotation at the bottom plate (12) and is in sliding contact therewith. The cushion mat (16) is removably fastened at the cover plate (14) by the fastening ring, which is composed of a plurality of identical ring segments (19) which are individually locked at the cover plate (14) and can be removed by manually exerting a lifting force thereon. All components of the rotary table (10) can be separately cleansed and reassembled thereafter without needing tools.

13 Claims, 2 Drawing Sheets

FIG. 3
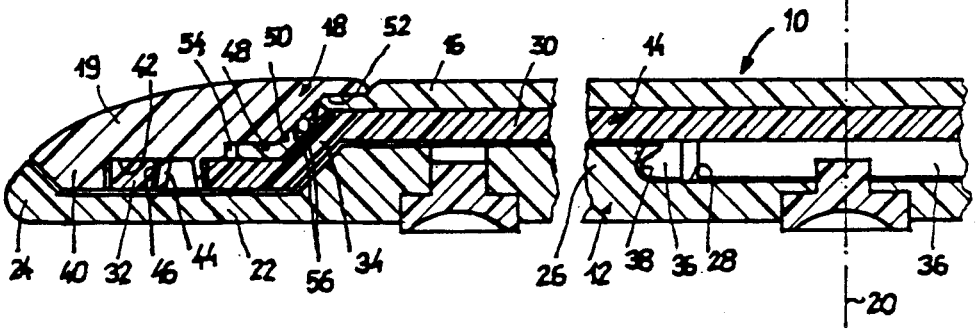
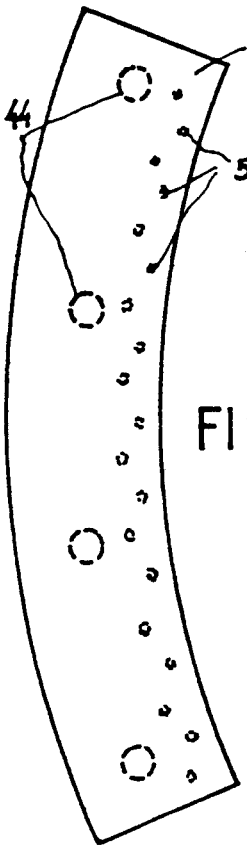
FIG. 4
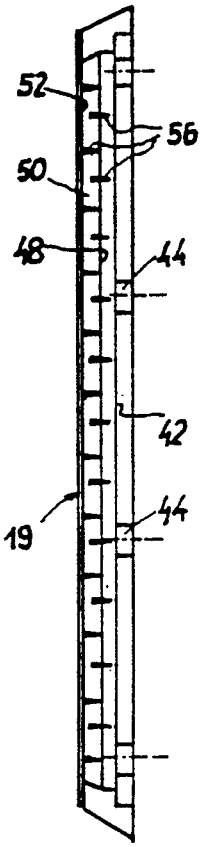
FIG. 5

ROTARY TABLE

BACKGROUND OF THE INVENTION

This invention relates to a rotary table to be used as a seat for a handicapped person, consisting of a bottom plate and a cover plate, the latter having a circular peripheral edge and being parallel arranged with and mounted for rotation on said bottom plate.

DESCRIPTION OF THE PRIOR ART

A rotary table of this kind is known from U.S. Pat. No. 2,757,388. However, the known rotary table is designed for standing persons. A ball bearing ring is provided between the bottom plate and the cover plate. Handicapped persons must frequently sit for long periods on a seat which must be rotatable about 90 degrees to bring the legs of the persons in a new position. Such a seat can be arranged on a chair, in a bed and on a lifting device arranged in a bathtub etc., in order to turn a sitting person, who himself is not able to do so.

The known rotary table is not appropriate for this purpose. At first a seat must have a soft cushion mat for indolent sitting. Then it must be possible to easily clean the cushion mat and to exchange it but nevertheless, the cushion mat must be undisplaceably secured at the cover plate. Furthermore the rotary table must have a height or thickness as small as possible to provide unstable conditions. On the other hand the rotary table must have a high flexural strength to allow a rotational movement even if impressed into a soft mattress.

SUMMARY OF THE INVENTION

Therefore, it is one object of the present invention to provide a rotary table for a sitting handicapped person which fulfills the above mentioned requirements.

One further object of the invention is to provide a rotary table which comprises an undisplaceable soft cushion mat, which can easily be removed and replaced by another one without needing tools.

One further object of the invention is to provide a rotary table which can easily be dismantled to completely clean the components thereof.

Last but not least an object of the invention consists in that a soft, flexible circular mat is centrally arranged on the cover plate, and a circular fastening ring extending around the peripheral edge of the cover plate is removable fastened thereon, the fastening ring overlapping a peripheral edge of the mat and clamping said peripheral edge of the mat against the cover plate.

By omitting any ball bearing means between the cover plate and the bottom plate, the components of the rotary table can be easily dismantled. Furthermore the sliding friction between the cover and bottom plates provides for a sufficient resistance against unintentional rotational movements which would otherwise occur as a reaction of body movements of the person if ball bearings would be assembled.

According to one embodiment of the invention the peripheral edge of the soft cushion mat is not only actuated by clamping means but also held in place positively by means of sharp-edged deflections of the mat peripherals edge and/or by spikes protruding into the mat.

BRIEF DESCRIPTION OF THE DRAWINGS

FIG. 3 shows an enlarged cross-section of the rotary table;

FIG. 4 shows a plan view of the ring segment omitted in FIG. 1; and

FIG. 5 shows a side view of the ring segment of FIG. 4 as seen in radial outward direction.

DESCRIPTION OF THE PREFERRED EMBODIMENT

Figure 1:
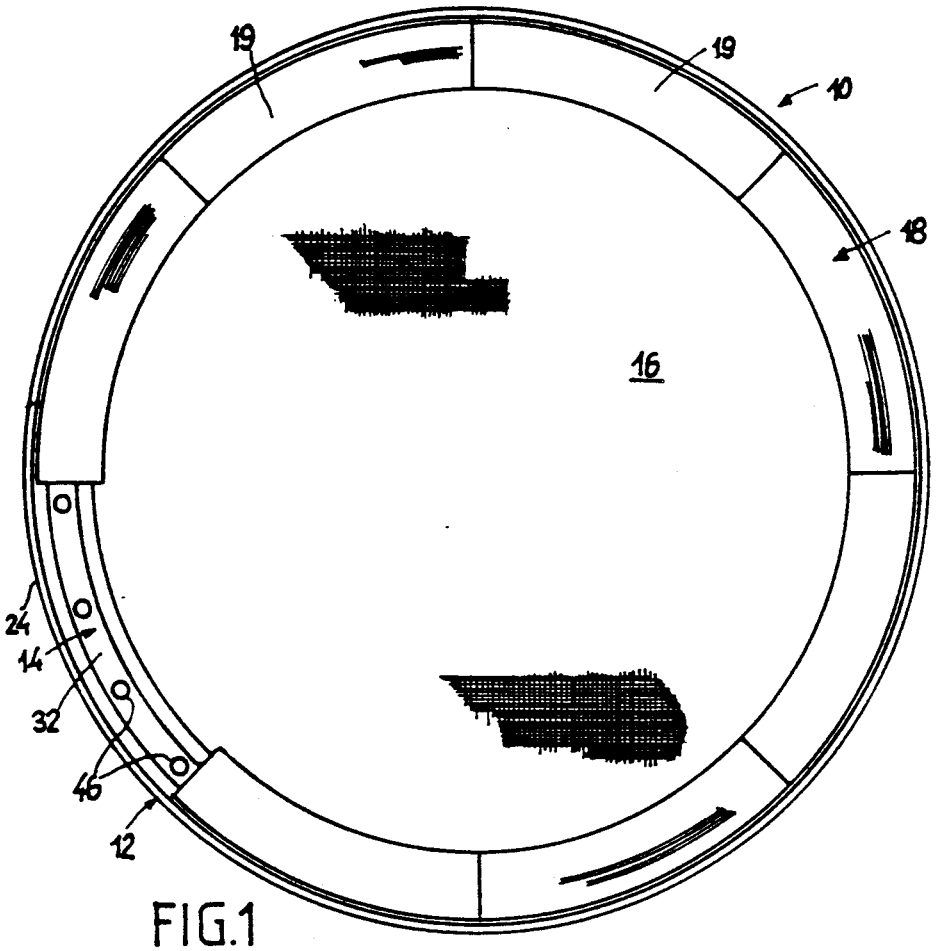
FIG. 1 shows a plan view of the rotary table comprising a plurality of ring segments, one of them being removed.
Figure 2:
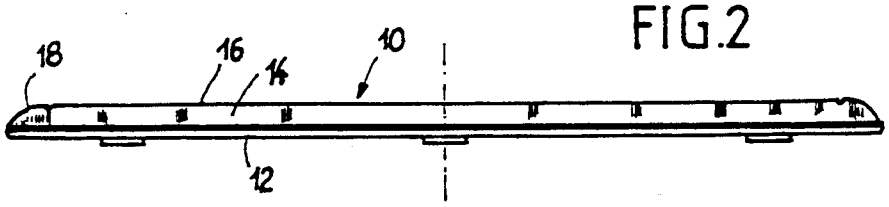
FIG. 2 shows a side view of the rotary table according to FIG. 1.

A rotary table 10 consists of a bottom plate 12, a cover plate 14, a flexible soft cushion mat 16 supported by the cover plate 14, and a fastening ring 18 overlapping the peripheral edge of the mat 16 and clamping the mat at the cover plate 14. These four components consist of plastics and are coaxially arranged with respect to a central axis 20.

The bottom plate 12 comprises a thin-walled outer flange 22 provided with an elevated rounded peripheral rim 24, and a thick-walled circular central portion 26 having a substantial planar upper bearing surface. The bottom surface of the bottom plate 12 is substantially planar. A co-axial circular opening 28 is provided in the central portion 26 and tapers slightly to the upper end thereof thus forming a peripheral recess. A plurality of suction cups are inserted from below into the bottom plate 12.

The cover plate 14 comprises a circular central portion 30 contacting the bottom plate central portion 26 and supported thereon for a rotational movement, a planar outer flange 32 arranged on a lower level, and a conical connection wall 34 connecting flange 32 to central portion 30. A planar running gap is formed between both flanges 22, 32. Four circularly extending snap-in tongues 36 are moulded at the bottom surface of the central portion 30 of the cover plate 14 and are provided with outer beads or rims 38 near the bottom side thereof respectively. The beads 38 have an outer diameter somewhat larger than the diameter of the upper end of the opening 28, so that the tongues 36 engage into the peripheral recess of the opening 28. The tongues 36 center the cover plate 14 at the bottom plate 12 radially and prevent an axial get-off of the cover plate 14. By bending the outer flange 22 of the bottom plate 12 downwards and away from the outer flange 32 of the cover plate 14 the running gap therebetween becomes broadened and a person can grip with a finger into the gap to lift off the cover plate 14, whereby the tongues 36 are elastically bent inwards and the beads 38 thereof can pass at the upper edge of the opening 28.

The fastening ring 18 is composed of eight identical ring segments 19, each having planar end faces arranged in axial planes of the rotary table 10 and abutting one another at that axial planes. The upper surface of the fastening ring 18 is convexly curved and without any step runs smoothly into the outer contour of the rim 24. The fastening ring 18 has a peripheral edge 40 which encompasses the outer flange 32 of the cover plate 14 and itself is encompassed by the circular outer rim 24 of the bottom plate 12 providing a running gap therebetween. An off-set planar supporting surface 42 adjoins outer rim 40 and contacts the outer flange 32 of the cover plate 14. Four snap-in connectors 44 extend downwards from the supporting surface 42 of each ring segment 19 and are removably snapped into holes 46 of the outer flange 32 of the cover plate 14. An annular gap 54 adjoins the inner end of the supporting surface 42, in that with a step a first planar limiting ring surface 48 is formed at the fastening ring 18, an upwardly tapering conical inner surface 50 adjoins the ring surface 48 with a sharp edge and the upper end of the conical inner surface 50 is connected with an elevated planar limiting ring surface 52 by means of a sharp edge. These two ring surfaces 48, 52 and the conical inner surface 50 form a double-angled upper clamping surface. A correspondingly designed double-angled lower clamping surface is formed by the upper surfaces of the outer flange 32, the conical connection wall 34 and the adjacent ring area of the central portion of the cover plate 14. Therefore, the annular gap 54, limited by theses upper and lower clamping surfaces is double-angled and sharp edges are provided at both ends of the conical surfaces. The annular gap 54 has a substantially Z-like cross-section and is of constant width which is somewhat smaller than the thickness of the cushion mat 16. Therefore the outer peripheral edge of the mat 16 is compressed and positively received in the annular gap 54. Both the clamping action and the form-fit design hold the mat 16 undisplaceably on the cover plate 14. Furthermore, two peripheral rows of spikes 56, integrally moulded at the conical inner surface 50 of the fastening ring 18 project downwardly substantially parallel with the rotating axis 20, pierce into the mat 16 and extend down with only a small space from the conical connection wall 34 of the cover plate 14.

The rotary table 10 can be dismantled in that the ring segments 19 of the fastening ring 18 one after another are removed by bending the rim 24 of the bottom plate 12 locally downwards and lifting off the respective ring segment 19. Then the mat 16 can be removed and the cover plate 14 and the bottom plate 12 can be separated by bending the outer flange 22 of the bottom plate 12 away from the cover plate 14 and exerting an axial pressure therebetween to let the tongues 36 snap out of the opening 28. The components of the rotary table 10 can be cleansed and re-assembled without needing tools.

I claim:

1. A rotary table to be used as a seat for a handicapped person, comprising:

a bottom plate and a cover plate, the cover plate having a circular peripheral edge, means for rotatably mounting the cover plate on the bottom plate, a soft, flexible circular mat centrally arranged on the cover plate and having a peripheral edge, a circular fastening ring extending around the peripheral edge of the cover plate and overlapping the peripheral edge of the mat, the fastening ring having a bottom surface, and clamping means for clamping the peripheral edge of the mat against the cover plate, the clamping means comprising a plurality of holes provided in the peripheral edge of the cover plate and a plurality of snap-in connectors extending downwardly from the bottom surface of the fastening ring and removably snapped into said holes.

2. A rotary table as claimed in claim 1, wherein the periphery of the mat is smaller than that of the cover plate, the fastening ring has an outer peripheral area and an inner peripheral area, the outer peripheral area of the fastening ring directly contacts the cover plate and an annular gap is formed between the inner peripheral area and the cover plate, and the peripheral edge of the mat projects into said annular gap.

3. A rotary table as claimed in claim 2, wherein a conical connection wall of the cover plate connects a planar central portion thereof with a circular outer flange arranged on a lower axial level than the central portion, the conical connection wall and a conical inner surface of the fastening ring forming limiting surfaces of the annular gap, which is composed of two planar end portions and a conical intermediate portion which forms sharp angles at upper and lower edges of said limiting surfaces and which has substantially a constant width.

4. A rotary table as claimed in claim 2, wherein at least at one limiting surface of the annular gap a belt of spikes is provided, the spikes projecting into the mat.

5. A rotary table as claimed in claim 8, wherein the spikes project downwardly from a conical inner surface of the fastening ring substantially in axial direction.

6. A rotary table as claimed in claim 1, wherein the bottom plate is provided with an elevated planar central portion and wherein the cover plate with a bottom surface thereof is directly supported by said central portion.

7. A rotary table as claimed in claim 3, wherein a central circular opening is provided in the central portion, the opening is provided with a peripheral recess, a plurality of flexible snap-in tongues are integrally formed at the cover plate on a diameter substantially equal with that of the opening and extend downwards from the bottom surface of the cover plate and engage into the peripheral recess thereby centering the cover plate and at the same time providing a lock against unintentional axial dismantling.

8. A rotary table as claimed in claim 1, wherein the fastening ring encompasses the cover plate at an outer peripheral edge thereof and wherein the bottom plate also is circularly shaped and has an outer diameter at least equal with that of the fastening ring.

9. A rotary table as claimed in claim 1, wherein the fastening ring is composed of a plurality of identical ring segments having a pair of end faces respectively arranged in axial planes, the end faces of adjacent ring segments are in contact with one another and wherein each ring segment is individually removably fastened at the cover plate by the snap-in connectors.

10. A rotary table as claimed in claim 1, wherein the bottom plate at its outer peripheral edge is provided with an elevated rim encompassing with a running fit an outer edge of the fastening ring.

11. A rotary table to be used as a seat for a handicapped person, comprising:

a bottom plate and a cover plate, the cover plate having a circular peripheral edge, means for rotatably mounting the cover plate on the bottom plate, a soft, flexible circular mat centrally arranged on the cover plate and having a peripheral edge, a circular fastening ring extending around the peripheral edge of the cover plate and overlapping the peripheral edge of the mat, and clamping means for clamping the peripheral edge of the mat against the cover plate, the bottom plate being provided with an elevated planar central portion and wherein the cover plate with a bottom surface thereof is directly supported by said central portion, a central circular opening in the central portion, the opening being provided with a peripheral recess, a plurality of flexible snap-in tongues integrally formed at the cover plate on a diameter substantially equal with that of the opening and extending downwardly from the bottom surface of the cover plate and engaged into the peripheral recess thereby for centering the cover plate and at the same time providing a lock against unintentional axial dismantling.

12. A rotary table to be used as a seat for a handicapped person, comprising:

a bottom plate and a cover plate, the cover plate having a circular peripheral edge, means for rotatably mounting the cover plate on the bottom plate, a soft, flexible circular mat centrally arranged on the cover plate and having a peripheral edge, a circular fastening ring extending around the peripheral edge of the cover plate and overlapping the peripheral edge of the mat, and clamping means for clamping the peripheral edge of the mat against the cover plate, the periphery of the mat being smaller than that of the cover plate, the fastening ring having an outer peripheral area and an inner peripheral area, the outer peripheral area of the fastening ring directly contacting the cover plate and an annular gap being formed between the inner peripheral area and the cover plate, the peripheral edge of the mat projecting into the annular gap, and a belt of spikes at at least one limiting surface of the annular gap, the spikes projecting into the mat.

13. A rotary table as claimed in claim 12, wherein the spikes project downwardly from a conical surface of the fastening ring substantially in an axial direction.

* * * * *